US005396033A

United States Patent [19]

Piriz et al.

[11] Patent Number: 5,396,033

[45] Date of Patent: Mar. 7, 1995

[54] H-TAP COMPRESSION CONNECTOR

[75] Inventors: Jose M. Piriz, Hillside; William O. Deck, Union, both of N.J.; Francis A. O'Loughlin, Cordova, Tenn.

[73] Assignee: Thomas & Betts Corporation, Memphis, Tenn.

[21] Appl. No.: 987,944

[22] Filed: Dec. 9, 1992

[51] Int. Cl.[6] ..... H01R 4/18

[52] U.S. Cl. ..... 174/94 R; 174/71 R; 174/84 C; 403/275; 403/391; 439/877

[58] Field of Search ..... 174/94 R, 84 C, 71 R; 29/863, 872; 439/877; 403/275, 391

[56] References Cited

U.S. PATENT DOCUMENTS

| | | | |
|---|---|---|---|
| 3,236,938 | 2/1966 | Toedtman | 174/94 R |
| 3,322,888 | 5/1967 | Zemels | 174/94 R |
| 3,897,992 | 8/1975 | Weidler | 174/84 C X |

FOREIGN PATENT DOCUMENTS

| | | | |
|---|---|---|---|
| 2011859 | 10/1979 | Germany | 174/94 R |

*Primary Examiner*—Morris H. Nimmo
*Attorney, Agent, or Firm*—Thomas & Betts Corp.

[57] ABSTRACT

An H-Tap compression connection accommodates a pair of electrical conductors. The connector includes a connector body having a nest for receipt of the conductor. The nest is defined by a bottom wall and an opposed pair of upstanding sidewalls. The sidewalls are inwardly deformable upon application of a crimping force to deform around the conductor. One of the sidewalls includes a weakened portion so that the one sidewall deforms prior to the other sidewall. This permits the sidewalls to overlap around the conductor during crimping.

8 Claims, 1 Drawing Sheet

H-TAP COMPRESSION CONNECTOR

FIELD OF INVENTION

The present invention relates generally to compression type connectors for connecting electrical conductors. More particularly the present invention relates to an H-Tap electrical connector, which provides compression connection between at least two conductors.

BACKGROUND OF THE INVENTION

Compression connectors for connecting together two or more electrical conductors are well-known. Connectors such as these typically accommodate stripped electrical conductors in individual connector nests. A suitable crimping tool is used to crimp the connector around the conductor. Many of these compression-type connectors are of the H-Tap variety, that is the connector body has an H-shaped cross section. H-Taps provide upper and lower conductor nests, each nest being defined by a bottom wall and upstanding sidewalls. The sidewalls are adapted to be deformed upon application of a crimping force applied by a crimping tool to draw the sidewalls around the conductor to thereby compress the conductor within the nest of the H-Tap.

In U.S. Pat. No. 2,964,585, an H-Tap compression connector is shown. The upper ends of the sidewalls are dimension such that upon crimping, the upper edges may not completely encircle the conductor. An attempt to lengthen the sidewalls could result in the sidewalls contacting each other during crimping prior to encircling the conductor thereby resulting in an ineffective crimp.

Attempts to solve this problem are seen in U.S. Pat. No. 3,235,654 where a deformable tab is provided at the outer edge of one of the sidewalls. The deformable tab may be folded over the conductor so that during crimping the conductor is entirely enclosed. Other examples of such connectors are shown in U.S. Pat. Nos. 3,354,517 and 3,330,903. However, it can be seen that employing extending tabs such as this greatly increases the cost of the connector as well as complicates the crimping operation.

A further attempt to provide a completely enclosed crimp in an H-Tap is shown in U.S. Pat. No. 5,162,615 where an H-Tap is provided having upstanding sidewalls of sufficient length to entirely encircle the conductor. In order to avoid the problem of the walls engaging one another prior to full crimping, this H-Tap provides one sidewall having an inwardly curled upper extent. Thus, upon application of a crimping force, the inwardly curled extent will cause this sidewall to deform prior to the other sidewall so that the sidewalls overlap about the conductor. While this solves the problem of encircling the conductor, it does require formation of an inwardly curled upper extent of the sidewall. This may present a problem in the field when conductors are inserted into the crimping nest as it reduces the opening in which the conductor is inserted. Also, the curved upper end may not be entirely reliable and may suffer from the disadvantages of the prior art H-Taps.

It is, therefore, desirable to provide an H-Tap connector which will permit the reliable overlapping of the side- walls of the nest during crimping.

SUMMARY OF THE INVENTION

It is an object of the present invention to provide an electrical connector for crimping about an electrical cable.

It is a further object of the present invention to provide an H-Tap compression connection which fully encircles the conductor upon crimping.

It is a still further object of the present invention to provide an H-Tap compression connector where one sidewall is designed to reliably deform prior to the other sidewall to permit crimping around a conductor.

In the efficient attainment of these and other objects, the present invention provides an electrical connector for crimping about an electrical cable. The connector includes a body having a nest for receipt of the cable. The nest includes a bottom wall and an opposed pair of upstanding sidewalls. The sidewalls are deformable upon application of a crimping force to deform around the cable. One of the sidewalls includes a weakened portion. This one sidewall deforms prior to the other sidewall upon the application of the crimping force.

As shown by way of preferred embodiment herein, the weakened portion of the sidewall includes a transverse notch extending therealong which causes the sidewall to more easily deform upon application of the crimping force.

DETAILED DESCRIPTION OF THE PREFERRED EMBODIMENT

Figure 1:
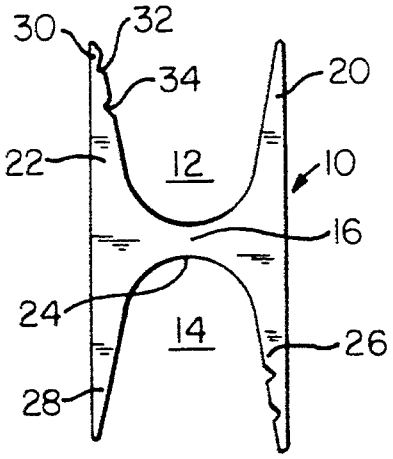
FIG. 1 shows a front plan view the H-Tap electrical compression connection of the present invention.

Referring to FIG. 1, an H-Tap compression connector 10 of the present invention is shown. Connector 10 is formed of a suitably conductive metal such as copper and is cut from an extruded length. Copper is selected as the preferable material for its high electrical conductivity as well as its ability to be suitable crimped by a crimping tool (not shown). It is, however, understood that other conductive metals such as aluminum may be employed and other forming techniques such as casting may also be used to form the connector of the present invention.

Connector 10 has a generally H-shaped cross-section providing oppositely directed upper and lower conductor receiving nests 12 and 14. These nests, 12 and 14, are separated by cross member 16 of the H-shaped connector. Conductor receiving nest 12 is defined by the bottom wall 18 and a pair of opposed upstanding sidewalls 20 and 22. Likewise, nest 14 is defined by bottom wall 24 and opposed sidewalls 26 and 28.

As may be appreciated, the size and shape of connector 10 may be varied to accommodate various lengths and thicknesses of cable. However, the sidewalls 20, 22 and 26, 28 are selected such that when a conductor is placed in nests 12 and 14 and suitably crimped, legs 20 and 22 will overlap each other as will legs 26 and 28 to encircle the conductors supported within the nests 12 and 14. In a typical crimping process, a suitable crimping tool (not shown) is employed. With respect to nest 12, upstanding sidewalls 20 and 22 are deformed inwardly by the crimping tool. Suitable crimping dies force the sidewall around the conductor supported within the nest 12. In order to assure that one sidewall overlaps the other sidewall upon crimping, the present invention contemplates providing a weakened portion on one of the sidewalls so that during the crimping operation it will deform prior to deformation of the other sidewall.

Figure 2:
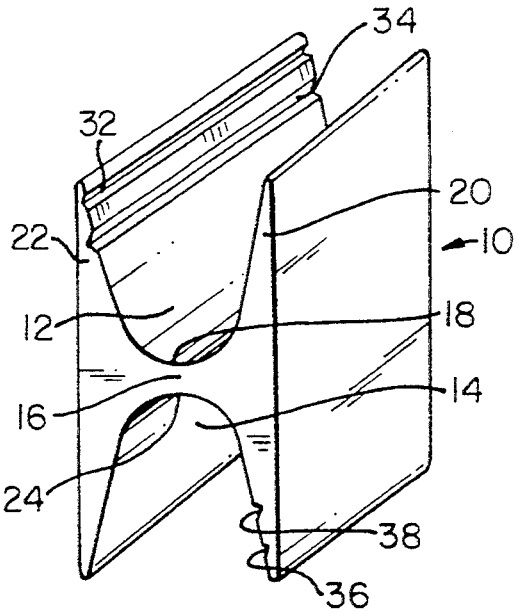
FIG. 2 is a perspective showing of the connector of FIG. 1.
Figure 3:
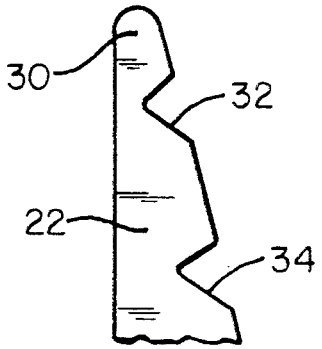
FIG. 3 is an enlarged showing of an outer extent of one sidewall of the connector shown in FIG. 1.

Referring additionally to FIG. 3, an upper extent 30 of sidewall 22 is shown. Upper extent 30 includes a pair of vertically spaced longitudinal grooves 32 and 34 extending along the inside surface thereof. Grooves 32 and 34 provide an area of reduced thickness for sidewall 22 thereby weakening the strength of the sidewall. Grooves 32 and 34 are generally v-shaped notches and provide a thinned wall area at upper extent 30. The shape of the notches formed by grooves 32 and 34 are conducive to collapsing upon compression, thereby driving inwardly extent 30 of sidewall 22. Upon application of a uniform crimp force to both sidewalls 20 and 22, grooves 32 and 34, having weakened the upper extent 30 of sidewall 22, will, therefore, cause sidewall 22 to deform prior to the deformation of sidewall 20. As seen in FIGS. 1 and 2, sidewall 26 forming part of nest 14 includes similar grooves 36 and 38 thereon which serve a purpose similar to that described above.

Figure 4:
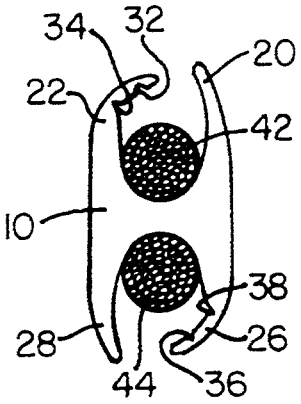
FIGS. 4–6 show in succession the H-Tap compression connection of FIG. 1 being crimped about a pair of electrical conductors.
Figure 5:
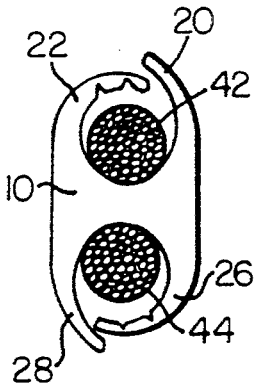
Figure 6:
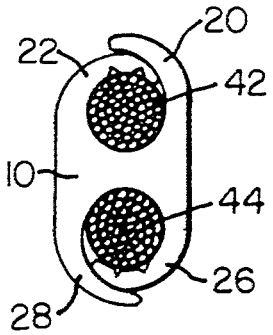

Referring now to FIGS. 4, 5 and 6, the successive steps in the crimping cycle may be seen. Stripped electrical conductors 42 and 44 are supported within nests 12 and 14 respectively. A conventional crimping tool (not shown) having dies specifically designed for crimping H-Tap connectors exerts a uniform crimping force on side- walls 20 and 22 as well as sidewalls 26 and 28 so that a compression connection is achieved between conductors 42 and 44. Upon application of the uniform crimping force, side- walls 22 and 26 will inwardly deform just prior to the inward deformation of sidewalls 20 and 28. As can be seen in FIG. 4, the above-described grooves 32, 34 and 36,38 provide a weakened section about which crimping deformation is more easily achieved. Continued application of the crimping force causes sidewalls 22 and 26 to wrap around conductors 42 and 44 respectively. Referring to FIG. 6, sidewalls 20 and 28 are then forced over deformed sidewalls 22 and 26 respectively to overlap conductors 42 and 44 thus achieving a compression connection which encircles the conductors.

The present invention contemplates employing compression connectors of various sizes and configurations for accommodating various cable diameters. It also contemplates employing connectors having additional nests for accommodating other cables. In addition, depending upon the size and shape of the conductor employed, various numbers of grooves may be employed along the sidewall to form the weakened portion.

Various changes to the foregoing described and shown structures would now be evident to those skilled in the art. Accordingly, the particularly disclosed scope of the invention is set forth in the following claims.

We claim:

1. An electrical connector for crimping about an electrical cable comprising:

a connector body having a nest for receipt of a cable, said nest being defined by a bottom wall and an opposed pair of elongate upstanding sidewalls, said sidewalls being inwardly deformable upon application of a tool-applied crimping force for deforming around said cable, one of said sidewalls including a weakened portion thereat for permitting said one sidewall to be deformed by said tool-applied crimping force prior to said other sidewall.

2. An electrical connector of claim 1 wherein said weakened portion includes said one sidewall having a transverse groove extending therealong.

3. An electrical connector of claim 1 where said weakened portion includes said one sidewall having a thinner wall thickness than said other sidewall.

4. An electrical connector of claim 2 wherein said transverse groove is v-shaped.

5. An electrical connector of claim 1 wherein said weakened portion includes said sidewall having a pair of vertically spaced transverse grooves extending therealong.

6. An electrical connector for crimpable connection about an electrical conductor upon application of a crimping force imparted by a die of a crimping tool, said connector comprising:

a connector body having a bottom wall and a pair of spaced apart upstanding elongate crimpably deformable sidewalls, said bottom wall and said sidewalls defining interiorly thereof an open ended conductor receiving nest;

one said sidewall including at a distal end thereof a die engagement extent, said die engagement extent including a weakened wall portion, said weakened wall portion facilitating crimping deformation of said sidewall thereat for permitting said one sidewall to be crimpably deformed upon application of a crimping force imparted by a die of a crimping tool prior to said other sidewall.

7. An electrical connector of claim 1 wherein said weakened portion of said one sidewall includes said one sidewall having a reduced wall thickness thereat.

8. An electrical connector of claim 1 wherein said weakened portion of said one sidewall includes a v-shaped groove therein.

* * * * *